US005829528A

United States Patent [19]

Uthe

[11] Patent Number: 5,829,528

[45] Date of Patent: Nov. 3, 1998

[54] IGNITION SUPPRESSION SYSTEM FOR DOWN HOLE ANTENNAS

[75] Inventor: Michael T. Uthe, Corcoran, Minn.

[73] Assignee: Enhanced Energy, Inc., Minnetonka, Minn.

[21] Appl. No.: 829,221

[22] Filed: Mar. 31, 1997

[51] Int. Cl.[6] ..... E21B 43/16; E21B 43/00; B65D 90/22

[52] U.S. Cl. ..... 166/305.1; 166/243; 220/88.3

[58] Field of Search ..... 166/59, 303, 60, 166/302, 305.1, 243; 220/88.3

[56] References Cited

U.S. PATENT DOCUMENTS

| | | | |
|---|---|---|---|
| Re. 30,738 | 9/1981 | Bridges et al. . | |
| 2,153,555 | 4/1939 | Gallery | 220/88.3 |
| 2,634,961 | 4/1953 | Ljungstrom . | |
| 3,170,519 | 2/1965 | Haagensen . | |
| 3,620,299 | 11/1971 | Wiseman, Jr. . | |
| 3,848,671 | 11/1974 | Kern . | |
| 3,880,236 | 4/1975 | Durning et al. . | |
| 3,918,942 | 11/1975 | Rechtsteiner et al. | 55/385 |
| 4,008,765 | 2/1977 | Anderson et al. . | |
| 4,140,179 | 2/1979 | Kasevich et al. . | |
| 4,140,180 | 2/1979 | Bridges et al. . | |
| 4,148,361 | 4/1979 | Christensen | 169/66 |
| 4,193,451 | 3/1980 | Dauphine . | |
| 4,398,597 | 8/1983 | Haberman . | |
| 4,449,585 | 5/1984 | Bridges et al. . | |
| 4,457,365 | 7/1984 | Kasevich et al. . | |
| 4,485,868 | 12/1984 | Sresty et al. . | |
| 4,485,869 | 12/1984 | Sresty et al. . | |
| 4,508,168 | 4/1985 | Heeren . | |

(List continued on next page.)

FOREIGN PATENT DOCUMENTS 1199106 1/1986 Canada .

OTHER PUBLICATIONS

U.S. Dept. of Commerce, "Readio–Frequency Heating," in Technologies of Delivery or Recovery for the Remediation of Hazardous Waste Sites, pp. 66–67, University of Cincinnati, OH, Jan./90.

Anderson, I. "Steam Cleaning Deals with Toxic Waste," New Scientist, p. 31, Nov. 1988.

Oma, K.H. et al., "In Situ Heating to Detoxify Organic–Contaminated Soils," Hazardous Material Control, pp. 14–19, Mar./Apr., 1989.

U.S. Dept. of Commerce, "Electro–Kinetics," in Technologies of Delivery or Recovery for Remediation of Hazardous Waste Sites, pp. 25–30, University of Cincinnati, OH, Jan. 1990.

U.S. Dept. of Commerce, "Vapor Extraction," in Technologies of Delivery or Recovery for the Remediation of Hazardous Waste Sites, pp. 44–45, Univ. of Cincinnati, OH Jan. 1990.

*Primary Examiner*—Tamara L. Graysay
*Assistant Examiner*—Gary S. Hartmann
*Attorney, Agent, or Firm*—Fredrikson & Byrpn, PA

[57] ABSTRACT

The invention provides an apparatus and a method for suppressing ignition of flammable materials in a borehole. The apparatus may include a down hole device having an upper end and a lower end, with a shaft extending between the upper and lower ends. A flexible sheath is carried about the shaft. The sheath is upwardly open to atmosphere and is sealed from the borehole adjacent its bottom end. A gas-receiving gap is defined between the sheath and the shaft. A cap seals the annulus between the borehole's wall and the flexible sheath, with the cap desirably sealingly engaging the sheath adjacent its upper end. An inert gas delivered to the gas-receiving gap through a delivery conduit. In one method of the invention, an apparatus as outline above is provided. The down hole device is placed in a borehole such that its upper end is positioned adjacent ground level and its lower end is positioned within the borehole. The annulus defined between the borehole's wall and the flexible sheath is sealed with a cap which sealingly engages the sheath adjacent its upper end. An inert gas is delivered to that gas-receiving gap to displace ambient air within the gap.

13 Claims, 1 Drawing Sheet

U.S. PATENT DOCUMENTS 4,524,827 6/1985 Bridges et al. .
4,545,435 10/1985 Bridges et al. .
4,553,592 11/1985 Looney et al. .
4,583,589 4/1986 Kasevich .
4,593,763 6/1986 Burke ..... 166/302
4,620,593 11/1986 Haagensen .
4,638,862 1/1987 Savage .
4,645,004 2/1987 Bridges et al. .
4,670,634 6/1987 Bridges et al. .
4,700,716 10/1987 Kasevich et al. .
4,705,108 11/1987 Little et al. .
4,765,406 8/1988 Frohling et al. ..... 166/247
4,765,902 8/1988 Ely et al. .
4,776,086 10/1988 Kasevich et al. .
4,805,698 2/1989 Baugh et al. .
4,899,827 2/1990 Poole .
5,018,576 5/1991 Udell et al. .
5,065,819 11/1991 Kasevich .
5,152,341 10/1992 Kasevich .
5,220,799 6/1993 Lievens et al. ..... 62/48.2
5,255,742 10/1993 Mikus ..... 166/303
5,474,129 12/1995 Weng et al. ..... 166/308
5,488,990 2/1996 Wadleigh et al. ..... 166/260
5,535,825 7/1996 Hickerson .
5,539,853 7/1996 Jamaluddin et al. .

IGNITION SUPPRESSION SYSTEM FOR DOWN HOLE ANTENNAS

FIELD OF THE INVENTION

The present invention provides an ignition suppression system which has particular utility in connection with antennae used near explosive substances, such as microwave or other radio frequency (RF) transmitters used to heat hydrocarbon-bearing underground formations.

BACKGROUND OF THE INVENTION

It is becoming increasingly common to utilize antennae to help extract hydrocarbons from underground formations. For example, underground formations containing crude oil or oil shale may be heated with microwave or other RF emissions to help improve the flow rates of the desired oil or kerogen. Much the same techniques can be used to improve the flow rates of hydrocarbon contaminants in underground formations to increase recovery rates of such contaminants in ground water remediation.

Haagensen's U.S. Pat. No. 4,620,593, the teachings of which are incorporated herein by reference, suggests an antenna for heating underground formations. As detailed in Haagensen's disclosure, such antennae typically include an RF generator positioned at or near ground level adjacent the borehole, a transmitting element positioned down in the borehole, and a waveguide extending between the RF generator and the transmitting element. The waveguide serves to transmit the wave from the generator to the transmitting element and the transmitting element radiates that energy into the surrounding ground formation. The transmitting element is commonly enclosed in a housing which serves to help isolate the transmitting element from the surrounding ground formation and the environment of the borehole.

Several investigators in this field have proposed enclosing the waveguide and/or the antenna in a pressurized enclosure. U.S. Pat. No. 4,398,597 (Haberman) details an enclosure for protecting the transmitting element in the event of a borehole collapse. In U.S. Pat. No. 4,583,589, the teachings of which are incorporated herein by reference, Kasevich has suggested enclosing the waveguide and pressurizing that enclosure.

Others have proposed using pressurized enclosures in other contexts in the oil drilling industry. For example, Hickerson has suggested enclosing a production tubing string through which crude oil is extracted and pressurizing that enclosure. The pressurized gas in the enclosure is used to control the pressure within the well casing which serves to control the height to which the oil rises in the casing. This, in turn, is said to permit control of the temperature drop of the extracted oil, helping to avoid condensation of paraffins and the like within the tubing.

Maintaining a pressurized enclosure within a borehole can be fairly expensive. In addition to the costs of the gas used to maintain the elevated pressure, the walls of the enclosure must be strong enough to withstand the pressure of the gas. Often this means that the enclosure must be made of a rigid material such as metal tubing or the like. This can significantly add to the capital cost of the equipment used at the site and can make installation of the equipment more difficult and more expensive.

SUMMARY OF THE INVENTION

The present invention provides an apparatus and a method for suppressing ignition of flammable materials in a borehole. One embodiment of an apparatus of the invention includes a down hole device having an upper end positioned adjacent ground level and a lower end positioned within the borehole at a location below the upper end. The down hole device includes a shaft which extends between the upper and lower ends. A flexible sheath is carried about the shaft of the down hole device and extends from a position adjacent the upper end of the down hole device to a position adjacent to, but spaced above, the lower end of the down hole device. The sheath is upwardly open to ambient atmosphere and is sealed from the environment of the borehole adjacent its bottom end. A gas-receiving gap is defined between the sheath and the shaft. A cap seals the annulus defined between the borehole's wall and the flexible sheath, with the cap desirably sealingly engaging the sheath adjacent its upper end. A supply of an inert gas is positioned adjacent ground level and a delivery conduit in fluid communication with the inert gas supply and with the gas-receiving gap delivers this inert gas to the gap.

In accordance with one method of the invention, a down hole device and a flexible sheath are provided. A shaft extends between the upper and lower ends of the down hole device and the flexible sheath is carried about the shaft. The sheath extends from a position adjacent the upper end of the down hole device to a position adjacent to, but spaced above, the lower end of the down hole device. The sheath is upwardly open to ambient atmosphere and is sealed from the environment of the borehole adjacent its bottom end, with a gas-receiving gap being defined between the sheath and the shaft. This device is placed in a borehole such that its upper end is positioned adjacent ground level and its lower end is positioned within the borehole at a location below the upper end. The annulus defined between the borehole's wall and the flexible sheath is sealed with a cap which sealingly engages the sheath adjacent its upper end. An inert gas is delivered to that gas-receiving gap to displace ambient air within the gap.

DETAILED DESCRIPTION OF THE PREFERRED EMBODIMENTS

Figure 1:
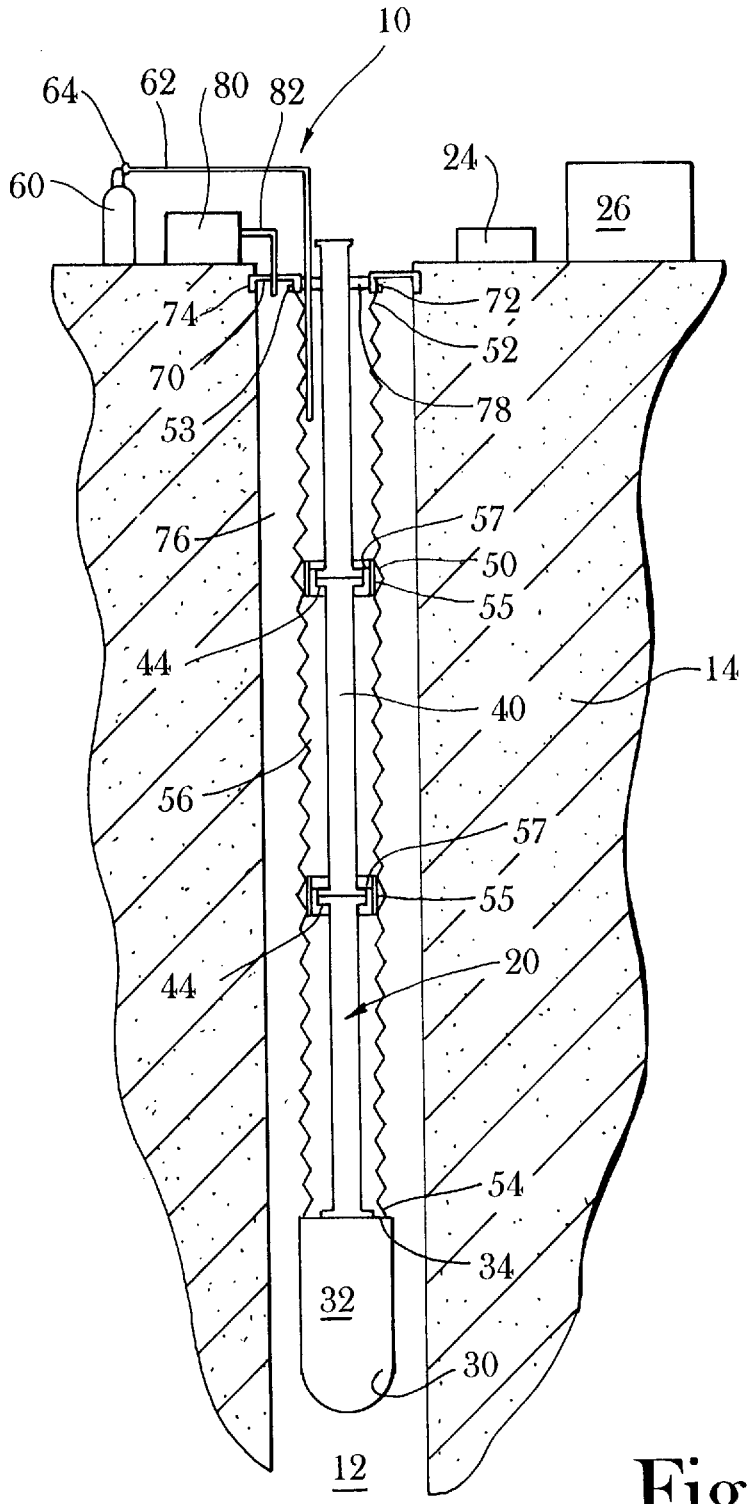
FIG. 1 is a schematic cross sectional view of an ignition suppression system in accordance with one embodiment of the invention.

FIG. 1 schematically illustrates one possible embodiment of an ignition suppression system 10 of the invention. A bore hole 12 extends downwardly into a geological formation 14 in the earth and a down hole device 20 extends downwardly within the bore hole 12. The bore hole obviously will be located to access the formation 14 to be heated or otherwise treated with the down hole device.

The down hole device 20 should be sized to be received within the bore hole 12. If so desired, the inner diameter of the bore hole can be close to the outer diameter of the down hole device, but that is not necessary to practice this invention. The selection of the proper location and relative size of the bore hole will depend on the nature of the down hole device and its intended use, but such selection is well within the skill of those practicing in this area and need not be discussed in any detail here.

The down hole device can be of any suitable shape and can have any useful function. Typically, though, the down hole device 20 will have an upper end 22 which will usually be positioned adjacent ground level so the operator can access the device without undue difficulty and a lower end 30 positioned within the borehole at a location below the upper end, usually at a location adjacent the area to be treated or accessed with the device. As will be well understood by those in the field, the top of a downhole structure is usually not precisely at ground level. It could be several fee below the level of the adjacent ground or, more typically, extend several feet above the level of the adjacent ground to enable easier access to any necessary fittings. Accordingly, when the top of the device or any other structure is said to be "adjacent ground level", it should be understood that this is a relative term and does not require the relevant structure be precisely aligned with the adjacent ground.

A shaft 40 typically extends between the upper and lower ends. This shaft can have any of a variety of different shapes, depending on the application for which the device is to be used. For many applications, a tubular shaft with a generally circular cross section will be acceptable. Although this shaft could be flexible, in may applications this shaft will be formed of a fairly rigid material, such as fairly stiff metal tubing capable of withstanding significant structural loads and internal pressures.

For example, in one preferred embodiment, the down hole device 20 is an RF antenna assembly. If this antenna assembly is to be used to remove hydrocarbons from a geological formation, the bore hole should extend downwardly through the overburden to a location positioned within the "pay zone" of the hydrocarbon-bearing formation. If the antenna assembly is instead to be used to remediate contaminated groundwater, the borehole would extend downwardly to a level adjacent, and preferably significantly below, the level of the water table at a location within the plume of contaminated water.

As illustrated by the differences between the various RF heating antennae shown in the Haagensen and Kasevich patents, the structure of an antenna assembly can vary depending on the application for which it is to be used and the relative priorities of various design objectives such as ease of use, efficiency, safety, etc. Generally speaking, though, an antenna assembly suitable for RF heating of a geological formation will include an RF generator 24, an antenna 30, and a shaft 40 which serves as a waveguide. In use, the antenna is positioned below ground level within the bore hole 12 at a location adjacent the section of the geological formation 14 the user desires to heat. The RF generator is most commonly positioned on the ground adjacent the bore hole rather than within the bore hole itself.

The shaft 40 is operatively connected to the RF generator 24 and to the antenna 30 and serves to transmit the RF waves produced by the generator down to the antenna. The antenna then radiates the RF waves into the surrounding media, heating the media and any petroleum products contained therein. The details of the structure of suitable antennae are discussed at length in the literature in this field and are beyond the scope of this disclosure. The Haagensen and Kasevich references mentioned and incorporated by reference above provide a number of designs suitable for use in connection with the present invention, though.

The antenna is desirably enclosed within an antenna housing 32. This housing should be transmissive of microwaves or other RF waves being generated by the antenna to heat the geological formation. Suitable materials noted in the art include fiberglass, Teflon, low dielectric ceramics and polyethylene. The housing 32 may generally include an elongate dome-shaped body sized to receive the transmitting element (not shown) therein. The housing 32 is desirably generally impermeable to fluids, i.e. the flow of gas or liquid through the wall of the housing is relatively inconsequential, but small amounts of fluid may pass through the housing or its fitting. Ideally, though, the housing is substantially fluid-tight and approaches a hermetic seal to minimize ingress of potentially explosive gases from the borehole into the housing.

If the down hole device 20 is such an antenna assembly, the shaft 40 should be formed of a material which can efficiently transmit the RF waves and which can withstand the rigors of the environment in which the antenna assembly will be used. Typically, these waveguides are formed of metal, preferably metals such as copper, stainless steel or aluminum. Waveguides can have differing shapes depending on the intended use of the antenna assembly. For example, Haagensen proposes one design for shorter lengths, while a somewhat more complex shape is disclosed for use in longer lengths where transmission losses are more critical.

If so desired, a cooling unit 26 can be provided for keeping the antenna 30 suitably cool during operation. Such a cooling unit can provide a cooled, inert gas to the interior of the shaft 40 for delivery to the antenna 30. By suitably cooling the gas and controlling the flow rate of the cooled gas, one can effectively manage the temperature of the antenna. The cooling unit may also include a system for conditioning the gas, such as a desiccant for removing moisture from the gas and/or a compressor for cooling the gas.

An ignition suppression system 10 of the invention also includes a flexible sheath 50 carried about the shaft of the down hole device 20. This flexible sheath desirably extends from a position adjacent the upper end 22 of the down hole device to a position adjacent to, but spaced above, the lower end 30 of the down hole device. As can be seen from FIG. 1, the shaft 40 can be allowed to extend upwardly beyond the top of the sheath, but both the upper end of the shaft and the upper end of the sheath are desirably positioned adjacent ground level.

The sheath 50 is desirably upwardly open to ambient atmosphere, i.e. its upper end 52 is in gas communication with the ambient atmosphere. The sheath also desirably is sealed from the environment of the borehole 12 adjacent its bottom end 54. In the illustrated embodiment, the bottom end 54 of the sheath is sealingly attached to the upper surface 34 of the antenna housing 32. As noted above, the housing 32 itself is substantially sealed against the ambient gas in the borehole.

The inner dimension of the sheath 50 is greater than the outer dimension of the shaft 40, defining a gas-receiving gap 56 therebetween. If both the shaft 40 and the sheath 50 are generally circular in cross section, this gap will be generally annular in shape. Sealing the bottom end 54 of the sheath to the exterior of the antenna housing 32 seals the bottom end of this gap 56, leaving it upwardly open much like a cup.

The sheath can be formed of any suitable material. Preferably, the sheath is relatively flexible and can be stretched or compressed in a generally axial direction. For example, the sheath can be formed of a multi-layered flexible material, such as a 4-ply construction of metal foil and a plastic film (e.g. Mylar™). In order to enhance flexibility, the sheath can have an accordion fold structure, permitting it to stretch and compress axially for ease of installation. Such materials are commercially available, being sold as flexible ductwork for construction trades. For example, one suitable product is sold under the trade name Flexwall.

The ignition suppression system 10 also includes a supply of an "inert" gas positioned adjacent ground level. As used herein, an "inert" gas is a gas which will help suppress the likelihood of an explosion. For example, various anaerobic gases such as $CO_2$ or nitrogen can be used to good effect. This will limit available oxygen and, hence, the likelihood of causing an explosion in the bore hole 12. In one possible embodiment, the gas may be supplied in the form of a cold liquid (e.g., liquid nitrogen) or even a solid (e.g., frozen $CO_2$ or "dry ice"). More commonly, though, the inert gas will be supplied from a pressurized tank or the like positioned on the ground or in a vehicle adjacent the top of the borehole.

The inert gas supply preferably also includes a regulator which is adapted to deliver gas to the gas-receiving gap at a constant, controlled rate. This is schematically illustrated in FIG. 1 as a simple valve 64. Any commercially suitable flow control system could obviously be used in this application.

The inert gas is preferably more dense than is the ambient air. This will permit it to substantially replace the atmosphere initially present in the gas-receiving gap 56. Since it is heavier than the air in this gap, it will descend beneath the air and generally fill the gap. Maintaining a constant flow of inert gas into the gap during the entire operation will allow the inert gas to overflow the sheath and be dispersed in the ambient air. Although this might be somewhat wasteful of the inert gas, it will ensure that the gas within the gap 56 remain substantially inert over time.

Providing an inert gas more dense than the ambient air can be accomplished by using a cooled gas which is more dense than ambient air due to its lower temperature. As the gas warms up in the gas-receiving gap 56, though, it will approach the same temperature as the ambient air. As a matter of fact, it will likely warm up to a temperature greater than that of the ambient air at ground level because the temperature in the bore hole at lower depths will tend to be higher.

It is preferred that the inert gas be more dense than ambient air at the same temperature. This will ensure that even if some air is present within the gap 56 (e.g. when the flow of inert gas is first started at the site), the inert gas at the same level, which is presumably at about the same temperature, will still be more dense and displace the air. One suitable gas which is more dense than is air at the same temperature is $CO_2$. Not only is $CO_2$ substantially inert, but it also is readily available and relatively inexpensive.

A delivery conduit 62 is in fluid communication with the inert gas supply 60 and with the gas-receiving gap 56. This delivery conduit may simply be a flexible hose which is attached at one end to a tank of inert gas while its other end simply hangs down within the gap 56. The inert gas will flow from the inert gas supply 60 into the gap through this conduit 62. Ideally, the delivery conduit hangs down into the gap 56 some distance, as shown, rather than terminating at the top of the gap. The exact position of the bottom end of the delivery conduit 62 within the gap 56 is not believed to be critical, but having the conduit extend down at least about half the length of the sheath 50 should suffice.

The ignition suppression system shown in FIG. 1 also includes a cap 70 which seals an annulus 76 defined between the wall of the borehole 12 and the flexible sheath 50. (Although this space is referred to for purposes of convenience as an annulus, it is to be understood that the shape of this space will depend on the exterior shape of the sheath and the interior shape of the borehole. If so desired, one or both of these elements can have a non-circular cross sectional shape, yielding an irregular or non-circular "annulus" 76.) It is via this annulus that the operator can access the environment of the borehole outside of the down hole device 20 and other equipment placed therein.

The cap sealingly engages the sheath 50 adjacent its upper end 52. In the illustrated embodiment, the cap includes a downwardly depending flange 72 defining an opening 78 therein. The shaft 40 of the down hole device is received through this opening 78 and the sheath may be attached directly to this flange. In the embodiment shown, the flange 72 is received in the upper portion of the sheath and the upper end 52 of the sheath is attached to the face of the flange disposed away from the interior of the opening 78. Although a friction fit may be sufficient in some circumstances, one may use a compression band 53 to hold the sheath firmly against the flange 72. For example, the compression band may be a length of a nylon cord pulled snugly against the exterior of the sheath.

Particularly in applications for treating deeper target formations, the weight of the sheath can be substantial. In some circumstances, therefore, it may be desirable to further support the weight of the sheath 50 along its length rather than simply allow it to hang from the flange 72 of the cap 70. FIG. 1 illustrates one suitable system for additionally supporting the weight of the sheath. In this system, the shaft 40 consists of several segments joined to one another, with a flange 44 extending radially outwardly where segments are joined to one another. A support ring 55, which may be little more than a short length of PVC tubing or the like, is attached to the inner surface of the sheath and is attached to the flange 44 using spaced-apart bolts 57 or the like. The bolts should be spaced from one another (not unlike spokes of a wheel) to allow gas to flow within the gap 56.

The relatively rigid shaft can therefore support the sheath. Although the spacing of such support rings 55 will depend on the specific application, it is believed that supporting the sheath 50 with a support ring every 20–25 feet will e more than adequate for most situations. If the sheath is purchased in segmented lengths rather than as a single, long piece, the segments can be joined to one another at the site of these support rings 55, allowing the rings to serve more than one function.

As noted above, it may be desirable to use an ignition suppression system of the invention in connection with the recovery of hydrocarbons from contaminated groundwater or the like. Many such systems utilize reduced pressures in the borehole. Although this obviously will not result in a complete vacuum within the borehole, this approach is often referred to as vacuum-assisted recovery. Such an approach can also be used in connection with the ignition suppression system 10 of the invention. This is schematically shown in FIG. 1 as a vacuum pump 80 and a vacuum line 82 extending from this pump, through the cap 70 and into the annulus 76 in the borehole. By reducing the pressure within this annulus, the relatively volatile hydrocarbons being recovered will be volatilized ad can be recovered from the gas withdrawn by the pump 80.

As noted above, the present invention also contemplates a method of suppressing ignition of flammable materials in a borehole. In accordance with the invention, a device generally as outline above is provided. It is to be understood that many of the details noted above are simply preferred structures, but that other, different structures can be used instead without departing from the method of the invention. The apparatus used in connection with the present method needs to continue to perform its intended function, but any other departure from the structure detailed above would be acceptable. Even so, the same reference numbers used in FIG. 1 are used in the following discussion solely for purposes of simplicity and continuity.

That being understood, an apparatus for use in connection with the invention will generally include a down hole device 20 and a flexible sheath 50. A shaft 40 extends between the upper 22 and lower 30 ends of the down hole device and the flexible sheath 50 is carried about the shaft. The sheath extends from a position adjacent the upper end of the down hole device to a position adjacent to, but spaced above, the lower end of the down hole device. The sheath is upwardly open to ambient atmosphere and is sealed from the environment of the borehole adjacent its bottom end, with a gas-receiving gap 56 being defined between the sheath 50 and the shaft 40.

In accordance with the present method, the down hole device 20 is placed in a borehole 12 such that its upper end 22 is positioned adjacent ground level and its lower end 30 is positioned within the borehole at a location below the upper end. The annulus 76 defined between the borehole's wall and the flexible sheath is sealed with a cap 70 which sealingly engages the sheath adjacent its upper end 52. An inert gas is delivered to that gas-receiving gap 56 to displace ambient air within the gap. If so desired, the pressure within the annulus 76 between the sheath 50 and the wall of the bore hole 12 can be reduced by pumping gas from that annulus using the pump 80.

The density and flow rate of the inert gas through the delivery conduit 62 can be controlled to maintain a generally inert atmosphere within the gas-receiving gap 56. By adjusting the composition and/or temperature of the inert gas, one can adjust the density. Using a regulator 64, an operator can manage the flow rate of the inert gas.

While a preferred embodiment of the present invention has been described, it should be understood that various changes, adaptations and modifications may be made therein without departing from the spirit of the invention and the scope of the appended claims.

What is claimed is:

1. An ignition suppression system for use in a borehole, comprising:

a. a down hole device having an upper end positioned adjacent ground level and a lower end positioned within the borehole at a location below the upper end, a shaft extending between the upper and lower ends;

b. a flexible sheath carried about the shaft of the down hole device and extending from a position adjacent the upper end of the down hole device to a position adjacent to, but spaced above, the lower end of the down hole device, the sheath being upwardly open to ambient atmosphere and being sealed from the environment of the borehole adjacent its bottom end, a gas-receiving gap being defined between the sheath and the shaft;

c. a cap sealing an annulus defined between the borehole's wall and the flexible sheath, the cap sealingly engaging the sheath adjacent its upper end;

d. a supply of an inert gas positioned adjacent ground level; and e. a delivery conduit in fluid communication with the inert gas supply and with the gas-receiving gap.

2. The ignition suppression system of claim 1 wherein the sheath has an inner dimension greater than the outer dimension of the shaft, defining a generally annular gap therebetween.

3. The ignition suppression system of claim 1 wherein the inert gas is more dense than ambient air at the same temperature.

4. The ignition suppression system of claim 1 wherein the supply of inert gas includes a regulator adapted to deliver gas to the gas-receiving gap at a constant, controlled rate.

5. The ignition suppression system of claim 1 wherein the down hole device comprises an antenna assembly.

6. The ignition suppression system of claim 5 wherein the antenna assembly comprises an RF generator and an antenna, the shaft of the down hole device comprising a waveguide connected at an upper end to the RF generator and at a lower end to the antenna.

7. The ignition suppression system of claim 6 wherein the antenna is enclosed within a housing.

8. The ignition suppression system of claim 7 wherein the sheath is attached adjacent a lower end to an exterior of the antenna housing.

9. The ignition suppression system of claim 8 wherein the sheath is sealingly attached to an upper surface of the antenna housing.

10. A method of suppressing ignition of flammable materials in a borehole comprising:

a. providing a down hole device having upper and lower ends, a shaft extending between said upper and lower ends, and a flexible sheath having upper and lower ends which is carried about the shaft and extends from a position adjacent the upper end of the down hole device to a position adjacent to, but spaced above, the lower end of the down hole device, the sheath being upwardly open and being sealed from the environment of the borehole adjacent its bottom end, a gas-receiving gap being defined between the sheath and the shaft;

b. placing the down hole device in a borehole such that its upper end is positioned adjacent ground level and its lower end is positioned within the borehole at a location below the upper end;

c. sealing an annulus defined between the borehole's wall and the flexible sheath with a cap which sealingly engages the sheath adjacent its upper end;

d. delivering an inert gas to the gas-receiving gap to displace ambient air within the gap.

11. The method of claim 10 wherein the inert gas is selected to be more dense than the ambient air.

12. The method of claim 10 further comprising controlling the density and flow rate of the inert gas to maintain a substantially inert atmosphere in a majority of the gas-receiving gap.

13. The method of claim 10 wherein the down hole device is an antenna apparatus, the method further comprising transmitting radio frequency waves from the antenna assembly into a surrounding geological formation to heat that formation.

* * * * *